US011719061B2

(12) United States Patent
Nguyen et al.

(10) Patent No.: US 11,719,061 B2
(45) Date of Patent: Aug. 8, 2023

(54) CASING EXIT ANCHOR WITH REDUNDANT ACTIVATION SYSTEM

(71) Applicants: Tuan Nguyen, Pearland, TX (US); Gregory Hern, Porter, TX (US)

(72) Inventors: Tuan Nguyen, Pearland, TX (US); Gregory Hern, Porter, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 92 days.

(21) Appl. No.: 17/393,697

(22) Filed: Aug. 4, 2021

(65) Prior Publication Data

US 2021/0363842 A1 Nov. 25, 2021

Related U.S. Application Data

(62) Division of application No. 16/829,048, filed on Mar. 25, 2020, now Pat. No. 11,136,843.

(51) Int. Cl.

| | |
|---|---|
| ***E21B 23/01*** | (2006.01) |
| ***E21B 29/06*** | (2006.01) |
| ***E21B 23/04*** | (2006.01) |

(52) U.S. Cl.

CPC ..... *E21B 23/01* (2013.01); *E21B 23/04* (2013.01); *E21B 29/06* (2013.01)

(58) Field of Classification Search

CPC ..... E21B 31/20; E21B 29/005; E21B 23/01; E21B 23/04

See application file for complete search history.

(56) References Cited

U.S. PATENT DOCUMENTS

| | | | |
|---|---|---|---|
| 3,080,923 | A | 3/1963 | Brown |
| 3,115,933 | A | 12/1963 | Haeber |
| 3,223,164 | A | 12/1965 | Otteman |
| 3,409,096 | A | 11/1968 | Brown |
| 4,216,835 | A | 8/1980 | Nelson |
| 5,002,131 | A | 3/1991 | Cromar et al. |
| 5,109,924 | A | 5/1992 | Juergens et al. |
| 5,431,220 | A | 7/1995 | Lennon et al. |
| 5,474,126 | A | 12/1995 | Lynde et al. |
| 5,592,991 | A | 1/1997 | Lembcke et al. |

(Continued)

FOREIGN PATENT DOCUMENTS

| | | | |
|---|---|---|---|
| EP | 0916014 | A1 | 5/1999 |
| WO | 02097234 | A1 | 12/2002 |

(Continued)

OTHER PUBLICATIONS

International Search Report and Written Opinion for International Application No. PCT/US2021/023602; International Filing Date Mar. 23, 2021; Report dated Jul. 1, 2021 (pp. 1-7).

(Continued)

*Primary Examiner* — Cathleen R Hutchins

(74) *Attorney, Agent, or Firm* — Cantor Colburn LLP

(57) ABSTRACT

A method of activating an anchor supported by a tubular in a wellbore having a casing tubular. The method includes introducing an activation force to an anchor setting system to release a biasing element arranged in a slip supported by a housing of the anchor. The biasing element is preloaded by a tensioning member arranged in an internal chamber of the anchor.

16 Claims, 5 Drawing Sheets

(56) References Cited

U.S. PATENT DOCUMENTS

| | | | |
|---|---|---|---|
| 5,699,858 | A | 12/1997 | McAnally |
| 5,709,265 | A | 1/1998 | Haugen et al. |
| 5,718,291 | A | 2/1998 | Lorgen et al. |
| 5,803,176 | A | 9/1998 | Blizzard, Jr. et al. |
| 5,878,818 | A | 3/1999 | Hebert et al. |
| 6,032,740 | A | 3/2000 | Schnitker et al. |
| 6,311,792 | B1 | 11/2001 | Scott et al. |
| 6,464,002 | B1 | 10/2002 | Hart et al. |
| 6,550,540 | B2 | 4/2003 | Trent |
| 6,695,056 | B2 | 2/2004 | Haugen |
| 7,178,609 | B2 | 2/2007 | Hart et al. |
| 7,878,253 | B2 | 2/2011 | Stowe et al. |
| 8,327,944 | B2 | 12/2012 | King et al. |
| 8,453,729 | B2 | 6/2013 | Harris et al. |
| 8,469,096 | B2 | 6/2013 | Mcgarian |
| 8,967,279 | B2 | 3/2015 | Hered et al. |
| 9,140,083 | B2 * | 9/2015 | Delgado ..... E21B 29/06 |
| 9,267,355 | B2 | 2/2016 | Lumbye |
| 10,227,823 | B2 | 3/2019 | Hern et al. |
| 10,563,471 | B2 | 2/2020 | Georgsen et al. |
| 10,577,882 | B2 | 3/2020 | Hulsewe |
| 10,724,319 | B2 | 7/2020 | Hulsewe |
| 2002/0170713 | A1 | 11/2002 | Haugen et al. |
| 2004/0007390 | A1 | 1/2004 | Zupanick |
| 2004/0238171 | A1 | 12/2004 | McGarian et al. |
| 2005/0039905 | A1 | 2/2005 | Hart et al. |
| 2006/0207771 | A1 | 9/2006 | Rios et al. |
| 2007/0044954 | A1 | 3/2007 | Dewey |
| 2009/0266544 | A1 | 10/2009 | Redlinger et al. |
| 2009/0266556 | A1 | 10/2009 | Swenson et al. |
| 2010/0012322 | A1 | 1/2010 | Mcgarian |
| 2010/0224372 | A1 | 9/2010 | Stowe et al. |
| 2010/0270031 | A1 | 10/2010 | Patel |
| 2010/0307736 | A1 | 12/2010 | Hearn et al. |
| 2010/0319997 | A1 | 12/2010 | King et al. |
| 2012/0255785 | A1 | 10/2012 | Gregurek et al. |
| 2012/0261193 | A1 | 10/2012 | Swadi et al. |
| 2013/0020084 | A1 | 1/2013 | Goodson |
| 2013/0168151 | A1 | 7/2013 | Grigor et al. |
| 2013/0199791 | A1 | 8/2013 | Hill, Jr. et al. |
| 2013/0269928 | A1 | 10/2013 | Zhou |
| 2013/0299160 | A1 | 11/2013 | Lott |
| 2013/0341048 | A1 | 12/2013 | Delgado et al. |
| 2014/0020904 | A1 | 1/2014 | Hill, Jr. et al. |
| 2014/0318780 | A1 | 10/2014 | Howard |
| 2015/0152703 | A1 | 6/2015 | Haun |
| 2016/0238055 | A1 | 8/2016 | Donovan |
| 2016/0348456 | A1 | 12/2016 | Laplante et al. |
| 2017/0030168 | A1 | 2/2017 | Akkerman |
| 2017/0306711 | A1 | 10/2017 | Hern et al. |
| 2017/0328177 | A1 | 11/2017 | Sheehan et al. |
| 2018/0209232 | A1 | 7/2018 | Hulsewe |
| 2018/0209233 | A1 | 7/2018 | Hulsewe |
| 2018/0320480 | A1 | 11/2018 | Jelly et al. |
| 2018/0334872 | A1 | 11/2018 | Vuyk |
| 2019/0003264 | A1 | 1/2019 | Swadi et al. |
| 2019/0106940 | A1 | 4/2019 | Korf et al. |
| 2019/0120005 | A1 | 4/2019 | Hulsewe |
| 2019/0330944 | A1 | 10/2019 | Crabb et al. |
| 2020/0011134 | A1 | 1/2020 | Nevlud et al. |
| 2020/0018131 | A1 | 1/2020 | Telfer et al. |
| 2020/0088001 | A1 | 3/2020 | Morland |
| 2020/0131886 | A1 | 4/2020 | Hora et al. |
| 2021/0301610 | A1 | 9/2021 | Nguyen et al. |
| 2021/0301615 | A1 | 9/2021 | Harrington et al. |

FOREIGN PATENT DOCUMENTS

| | | | |
|---|---|---|---|
| WO | 2006070204 | A2 | 7/2006 |
| WO | 2016209686 | A1 | 12/2016 |

OTHER PUBLICATIONS

International Search Report and Written Opinion for International Application No. PCT/US2021/023603; International Filing Date Mar. 23, 2021; Report dated Jul. 1, 2021 (pp. 1-7).

International Search Report and Written Opinion for International Application No. PCT/US2021/023604; International Filing Date Mar. 23, 2021; Report dated Jul. 1, 2021 (pp. 1-9).

International Search Report and Written Opinion for International Application No. PCT/US2021/023605; International Filing Date Mar. 23, 2021; Report dated Jul. 1, 2021 (pp. 1-8).

International Search Report and Written Opinion for International Application No. PCT/US2021/023606; International Filing Date Mar. 23, 2021; Report dated Jul. 1, 2021 (pp. 1-7).

International Search Report and Written Opinion for International Application No. PCT/US2021/023609; International Filing Date Mar. 23, 2021; Report dated Jul. 5, 2021 (pp. 1-10).

"Timken introduces two high performance alloy steel grades" Offshore Magazine, Offshore Staff, Nov. 11, 2013 (5 Pages).

C95400 Product Spec Sheet; Concast Metal Products, Jul. 27, 2010 (pp. 1-2).

C95510 Product Spec Sheet; Concast Metal Products, Dec. 22, 2010 (pp. 1-2).

Notification of Transmittal of the International Search Report and the Written Opinion of the International Searching Authority, or the Declaration; PCT/US2017/066117; dated Mar. 29, 2018; 13 pages.

Notification of Transmittal of the International Search Report and the Written Opinion of the International Searching Authority, or the Declaration; PCT/US2017/066119; dated Mar. 29, 2018; 10 pages.

* cited by examiner

CASING EXIT ANCHOR WITH REDUNDANT ACTIVATION SYSTEM

CROSS REFERENCE TO RELATED APPLICATIONS

This application is a divisional of U.S. application Ser. No. 16/829,048 filed Mar. 25, 2020, the disclosure of which is incorporated by reference herein in its entirety.

BACKGROUND

In the drilling and completion industry, boreholes are formed in a formation for the purpose of locating, identifying, and withdrawing formation fluids. Once formed, a casing may be installed in the borehole to support the formation. Often times, it is desirable to create a branch from the borehole. A whipstock is used to guide a window mill supported on a drill string through the casing into the formation at an angle relative to the borehole. The whipstock directs the window mill to form a window or opening in the casing.

Generally, a window milling system is lowered into the borehole to a selected depth. Once in position, an anchor is deployed to lock the whipstock to the casing. Typically, a setting system shifts a slip axially along a tubular. The slip radially expands and bites into the casing. The setting system may take the form of a hydrostatic actuator, a hydraulic actuator, or a mechanical weight set. If the actuator fails, the drill string must be removed from the borehole for repair. Removing the drill string to repair the actuator is a time consuming process. Given the need to increase efficiency at the rig floor, the art would be open to new systems for actuating an anchor for a casing window milling system.

SUMMARY

Disclosed is a method of activating an anchor supported by a tubular in a wellbore having a casing tubular. The method includes introducing an activation force to an anchor setting system to release a biasing element arranged in a slip supported by a housing of the anchor. The biasing element is preloaded by a tensioning member arranged in an internal chamber of the anchor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

A detailed description of one or more embodiments of the disclosed apparatus and method are presented herein by way of exemplification and not limitation with reference to the Figures.

Figure 1:
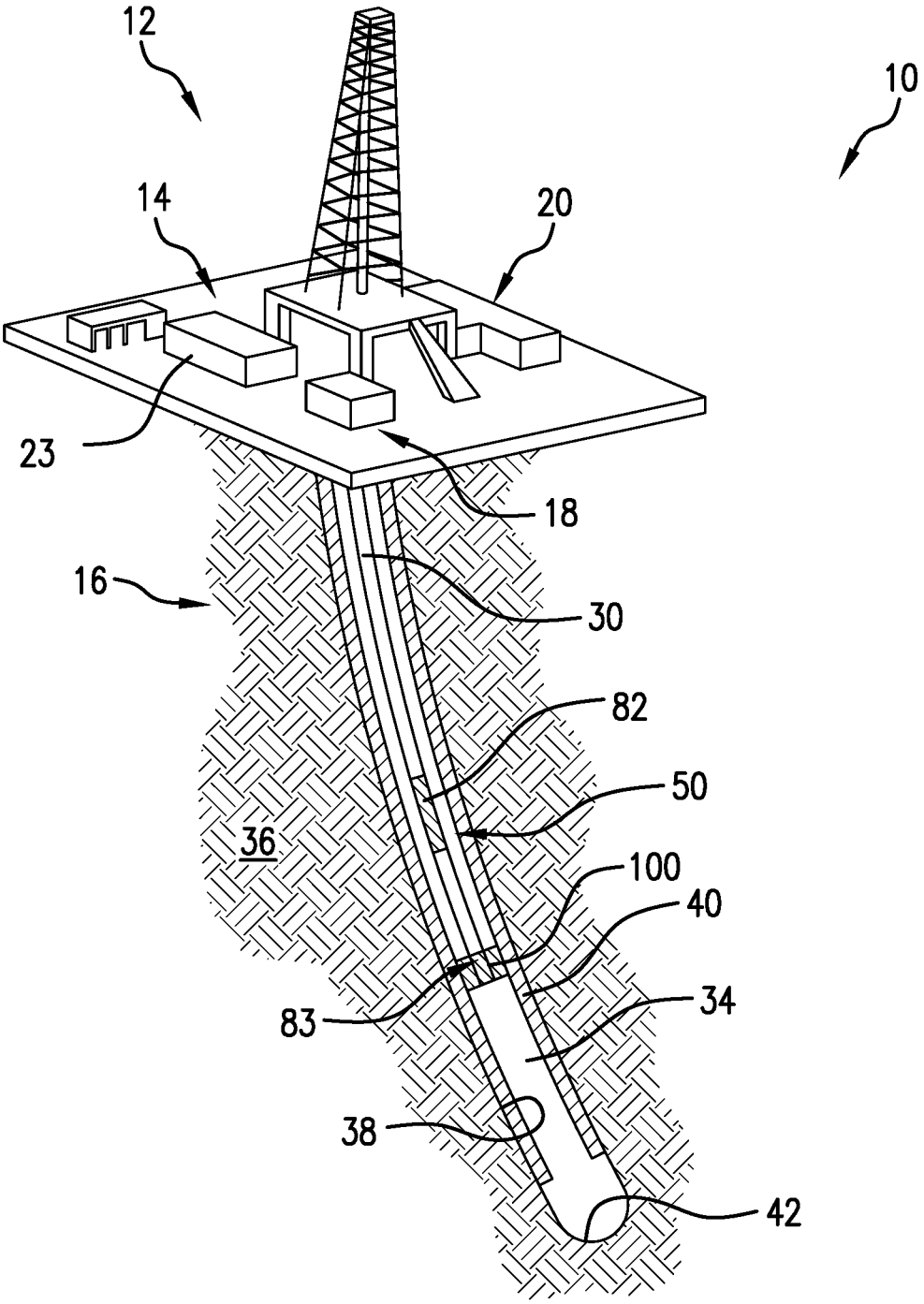
FIG. 1 depicts a resources exploration and recovery system including a Redundant Activation system, in accordance with an exemplary embodiment.

A resource exploration and recovery system, in accordance with an exemplary embodiment, is indicated generally at 10, in FIG. 1. Resource exploration and recovery system 2 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from one or more tubulars (not separately labeled) that is extended into a wellbore 34 formed in formation 36. Wellbore 34 includes an annular wall 38 that may be defined by a casing tubular 40 that extends from first system 12 towards a toe 42 of wellbore 34.

Figure 2:
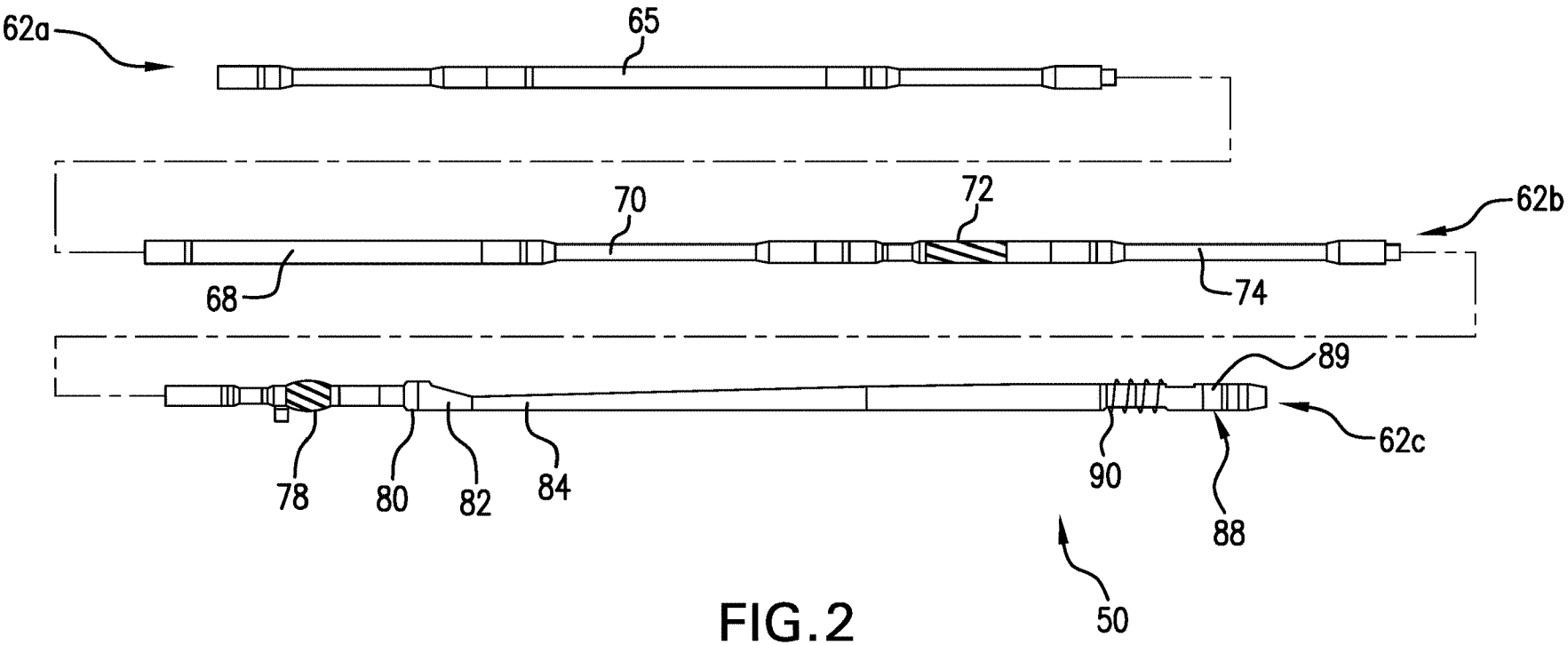
FIG. 2 depicts a window cutting system including a window mill and whipstock connector, in accordance with an exemplary embodiment.

In accordance with an exemplary aspect, a window cutting system 50 is connected to tubular string 30 and is introduced into wellbore 34. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*, 62*b*, and 62*c* as shown in FIG. 2. Each segment 62*a*, 62*b*, and 62*c* may be made up off-site and delivered to first system 12 for introduction into wellbore 34.

In an embodiment, first segment 62*a* may support a measurement while drilling (MWD) system 65 that includes various instrumentation systems which monitor window cutting operations. Second segment 62*b* may include a whipstock valve 68, a first flex joint 70, an upper watermelon mill 72, and a second flex joint 74. Third segment 62*c* may include a lower watermelon mill 78, a window mill 80, a whipstock connector 82, a whipstock 84, and an anchor 88 that may include one or more slips 89. Whipstock connector 82 serves as an interface between window mill 80 and whipstock 84. A scraper or brush 90 may be arranged on third segment 62*c* adjacent to anchor 88. Scraper or brush 90 may engage annular wall 38 so as to remove cement, debris or the like.

Figure 3:
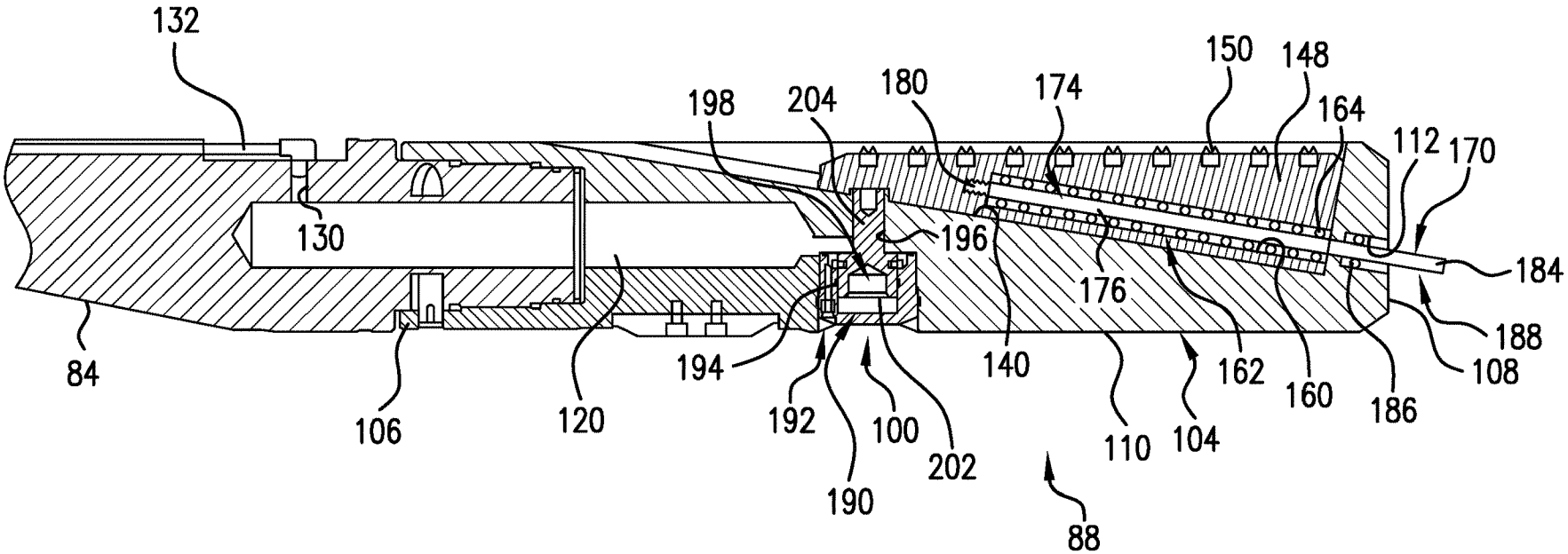
FIG. 3 depicts an anchor including a Redundant Activation system connected to the window cutting system, in accordance with an exemplary embodiment.

As will be detailed herein and shown in FIG. 3, anchor 88 includes a redundant anchor setting system 100. Redundant anchor setting system 100 may set anchor 88 using multiple setting methodologies without the need to reconfigure components of third segment 62*c* or withdraw tubular string 30 from wellbore 34. In an embodiment, anchor setting system 100 includes a housing 104 having a first end 106, a second end 108, and an outer surface 110. Second end 108 includes a recess 112. Recess 112 may be annular and be formed to have a selected diameter. Housing 104 includes an internal passage 120. A fluid inlet 130 is provided in housing 104 and fluidically connected to internal passage 120. A hydraulic line 132 extends from fluid inlet 130 to window mill 80.

In an embodiment, housing 104 includes an angled surface 140 that supports a slip 148 having a plurality of slip elements 150. Slip elements 150 are configured to "bite" into surfaces of, for example, casing tubular 40. The number of slips supported by housing 104 may vary. Slip 148 includes an internal chamber 160 that houses a biasing element 162. In an embodiment, biasing element 162 may take the form of a coil spring 164. Anchor setting system 100 includes a tensioning member 174 that may be employed to establish a preload on biasing element 162.

Tensioning member 174 is shown in the form of a tension adjustment rod 176 that extends into internal chamber 160. Tension adjustment rod 176 has a first end portion 180 that is connected to slip 148 through, for example, a threaded connection (not separately labeled) and a second end portion 184 that extends outwardly of second end 108 of housing 104. Tension adjustment rod 176 passes through recess 112 and includes a tension adjustment element 186. Tension adjustment element 186 may be rotated to shift first end portion 180 in internal chamber 160 to apply a compressive force to biasing element 162. Tension adjustment rod 176 may be employed as a mechanical actuator 188 to release slip 148 as will be detailed herein.

Figure 4:
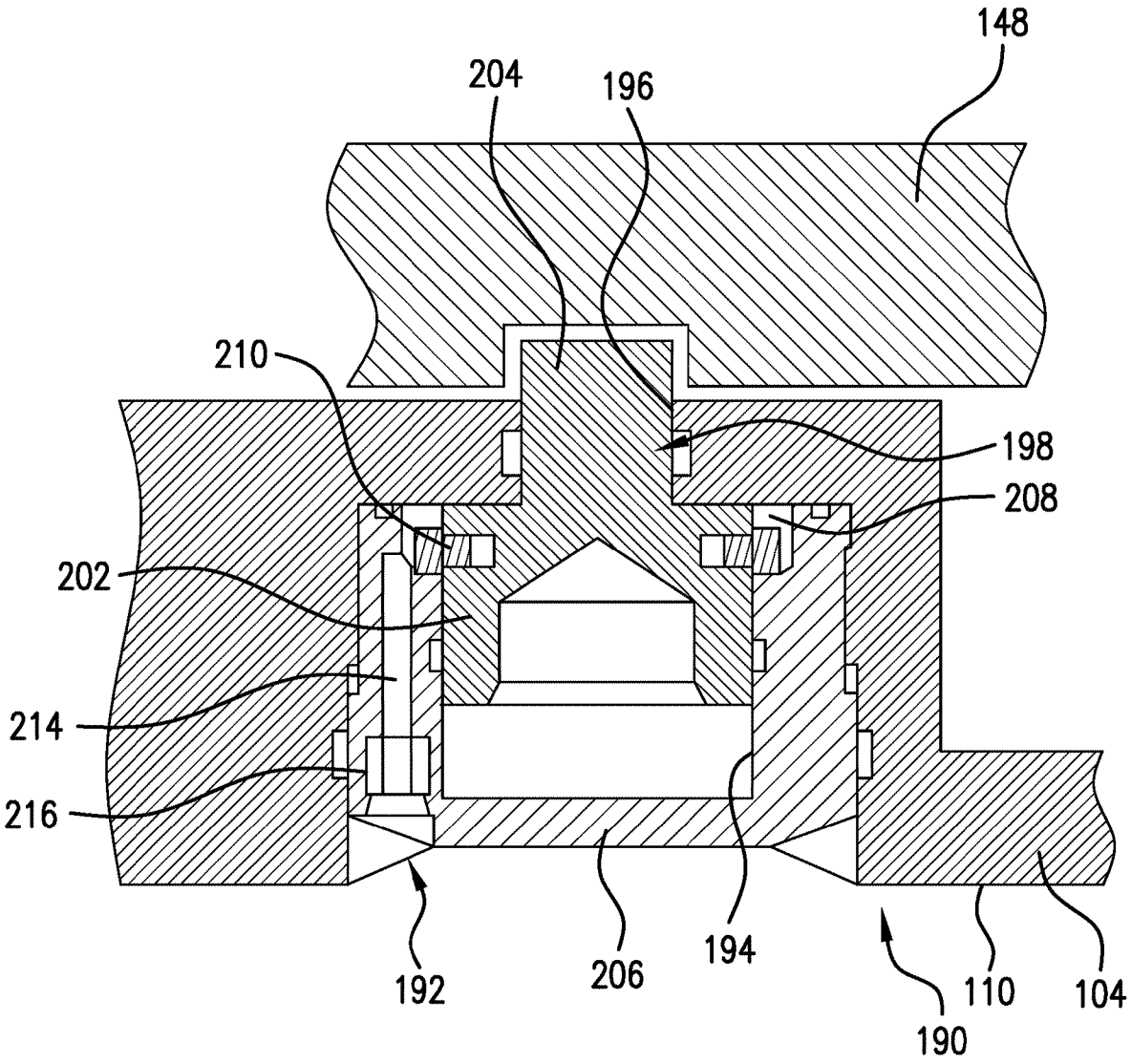
FIG. 4 depicts a trigger of the anchor setting system of FIG. 3, in accordance with an exemplary aspect.

In an embodiment, anchor setting system 100 includes a trigger 190 that is selectively activated to release slip 148. As shown in FIG. 4, trigger 190 is positioned in a piston cylinder 192 arranged in housing 104. Piston cylinder 192 includes a first cylinder portion 194 having a first diameter (not separately labeled) and a second cylinder portion 196 having a second diameter (also not separately labeled) that is smaller than the first diameter.

Trigger 190 includes a piston 198 having a first piston portion 202 and a second piston portion 204. First piston portion 202 includes a first diameter that corresponds to the first diameter (not separately labeled) of first cylinder portion 194 and second piston portion 204 includes a second diameter that corresponds to the second diameter of second cylinder portion 196. A plug or cap 206 is arranged in piston cylinder 192 trapping an amount of air radially outwardly of piston 198 forming an atmospheric chamber (not separately labeled).

A chamber 208 is arranged between first cylinder portion 194 and second cylinder portion 196. A shear element 210 locks piston 198 in piston cylinder 192. In the embodiment shown, a passage 214 extends through cap 206. A burst disc 216 selectively fluidically isolates passage 214 from, for example, wellbore 34. It should be understood, that trigger 190 may also function without burst disc 216.

In operation, a first activation force, such as raising fluid pressure raised in wellbore 34, is delivered to trigger 190 causing burst disc 216 to fracture. Fluid may pass through passage 214 and flow into chamber 208. Pressure in chamber 208 acts against piston 198 causing shear element 210 to fail allowing piston 198 to shift radially outwardly such that second piston portion 204 releases slip 148. Biasing element 162 then forces slip 148 along angled surface 140 and into contact with casing tubular 40 as will be detailed herein.

If the first activation force does not set anchor 88, a second activation force is delivered into housing 104 via fluid inlet 130. The second activation force acts on trigger 190 causing piston 198 to shift radially outwardly such that second piston portion 204 releases slip 148. The second activation force may be delivered without removing tubular string 30 or reconfiguring anchor 88. Further, if the second activation force fails to set anchor 88, tubular string 30 may be shifted into wellbore 34 such that mechanical actuator 188 contacts a wellbore surface driving tension adjustment rod into slip 148 shearing off second piston portion 204 allowing slip 148 to travel along angled surface 140. At this point, it should be understood that the particular order of activation forces employed to set slip 148 may vary. Further, it should be understood that if the first activation force sets anchor 88, there would be no need to deliver additional activation forces.

In accordance with an exemplary embodiment, anchor activation system 100 may be employed in a window milling operation. After being deployed into wellbore 34 to a selected position, measurement while drilling (MWD) may be used to determine whipstock orientation. Tubular string 30 may be rotated to orient whipstock 84 and anchor 88. An activation force is then delivered to trigger 190 to release slip 148. Biasing element 162 shifts slip 148 along angled surface 140 and into contact with casing tubular 40. After shifting slips(s) 148 into contact with casing tubular 40, tubular string 30 may be rotated to reposition whipstock 84 and anchor 88 at a new orientation. Set down weight is then applied through tubular string 30 to securely attach anchor 88 to casing tubular 40.

If it is determined that the whipstock is too close to a casing collar, whipstock 84 can be released from casing tubular 40 by applying an overpull force to tubular string 30. At this point, whipstock 84 may be relocated higher in wellbore 34 and locked in place through anchor 88 by applying set down weight through tubular string 30. At the higher location, whipstock 84 may be at a different angular orientation. The angular position or orientation of whipstock 84 may be determined by MWD system 65 or another telemetry system. At this point, window mill 80 may be deployed to mill a window in casing tubular 40.

Figure 5:
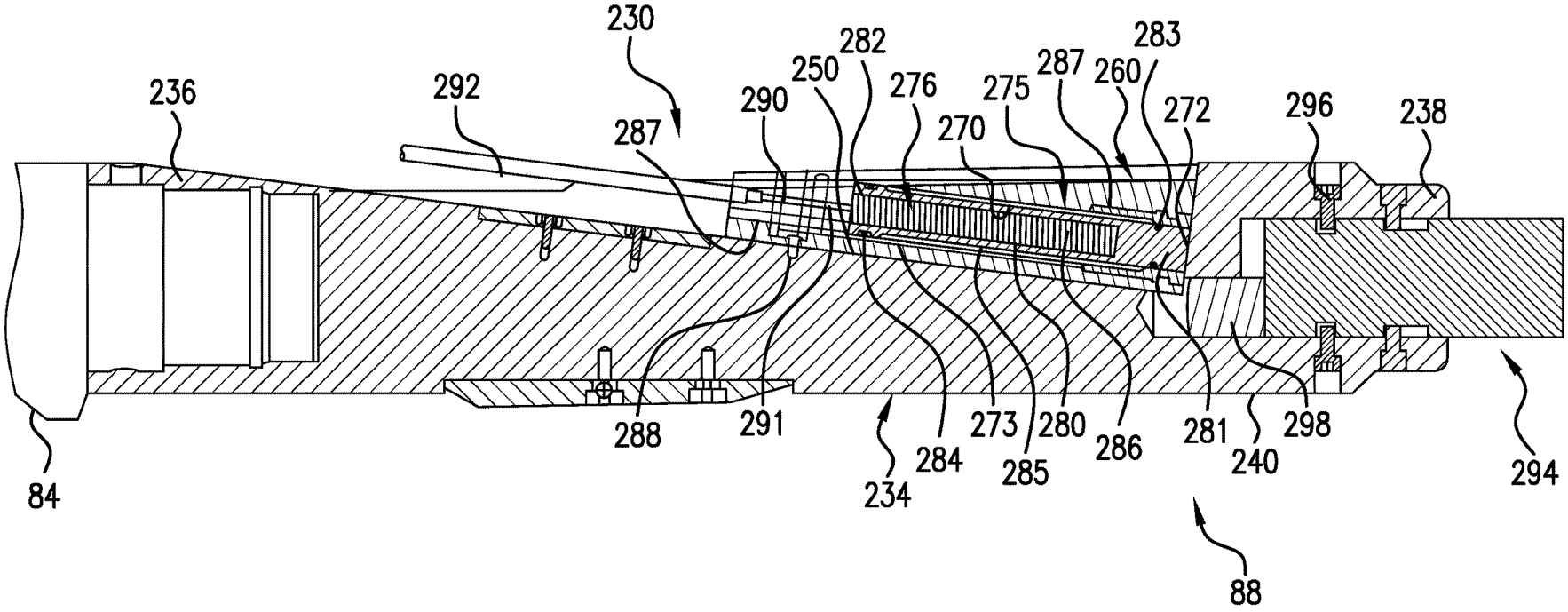
FIG. 5 depicts an anchor including a Redundant Activation system connected to the window cutting system, in accordance with another aspect of an exemplary embodiment.

Reference will now follow to FIG. 5 in describing an anchor setting system 230 in accordance with another aspect of an exemplary embodiment. Anchor setting system 230 includes a housing 234 having a first end 236, a second end 238, and an outer surface 240. Housing 234 includes an angled surface 250 that supports a slip 260 that may include a plurality of slip elements (not shown). Slip 260 includes an internal chamber 270 having a first end portion 272 and a second end portion 273.

A piston 275 is arranged in internal chamber 270. Piston 275 includes a first end section 281 and a second end section 282 and an internal zone (not separately labeled) that houses a biasing element 276. A first seal 283 may be arranged at first end section 281 and a second seal 284 may be arranged at second end section 282 creating an atmospheric chamber 285 therebetween in internal chamber 270. Biasing element 276 may take the form of a coil spring 286. A piston retainer 287 is arranged at first end portion 272 of internal chamber 270. Piston retainer 287 received first end section 281 of piston 275. Slip 260 is secured to angled surface 250 by a frangible fastener 288.

In an embodiment, a conduit 290 extends into internal chamber 270 and may direct a fluid from a hydraulic line 292 onto first end section 281 of piston 275. An upper end (not shown) of hydraulic line 292 is attached to window mill 80. An assembly tool (not shown) is used to compress biasing element 276. After biasing element 276 is compressed, and slip 260 is in desired position, frangible fasteners 288 are installed to hold slip 260 in position. The assembly tool is then removed to release biasing element 276.

Anchor setting system 230 also includes a mechanical actuator 294 that extends outwardly of second end 238 of housing 234. Mechanical actuator 294 is held in place by a plurality of frangible fasteners, one of which is shown at 296. An activator element 298 is arranged between mechanical actuator 294 and slip 260.

In operation, a first activation force, such as raising annular fluid pressure in wellbore 34, is delivered into conduit 290 and into an opening (not separately labeled) at first end 272 of slip 260. First end portion 281 of piston 275 is smaller than second end portion 282. Piston 275 is also shown to include a first seal 283 at first end portion 282 and a second seal 284 at second end 282. An atmospheric chamber 285 is present between first seal 283 and second seal 284. Since second seal 284 is larger than the first seal 283 (due to the disparity in size between the two ends) applying annular fluid pressure to both ends 281 and 282 of piston 275 forces slip 260 to move along angled surface 250 away from second end 238. The movement of slip 260 causes frangible fasteners 288 to fail. Once frangible fasteners 288 fail, biasing element 276 forces slip 148 along angled surface 250 and into contact with casing tubular 40 as will be detailed herein.

If the first activation force does not set anchor 88, a second activation force is delivered into slip 260 through hydraulic line 287 which is attached to conduit 290. The second activation force is delivered to first end section 281 of piston 275 to shift slip 260. The second activation force may be delivered without removing tubular string 30 or reconfiguring anchor 88. Further, if the second activation force fails to set anchor 88, tubular string 30 may be shifted into wellbore 34 such that mechanical actuator 294 contacts a wellbore surface breaking frangible fasteners 296 and driving activator element 298 against slip 260. Frangible fastener 288 fails allowing biasing element 276 to push slip 260 to travel along angled surface 250. At this point, it should be understood that the particular order of activation forces employed to set slip 260 may vary. Further, it should be understood that if the first activation force sets anchor 88, there would be no need to deliver additional activation forces.

At this point, it should be appreciated that the exemplary embodiments describe a system for activating a downhole anchor using redundant activation methodologies. The particular order of the activation methodologies may vary. Further the number of activation methodologies attempted for any given anchor activation operation may vary. That is the anchor activation system may be deployed once and, in the event that a primary activation methodology fails to activate the anchor, one or more backup activation methodologies may be employed without the need to remove the tubular string from the wellbore or reconfigure the anchor activation system.

Set forth below are some embodiments of the foregoing disclosure:

Embodiment 1. A method of activating an anchor supported by a tubular in a wellbore having a casing tubular, the method comprising: introducing an activation force to an anchor setting system to release a biasing element arranged in a slip supported by a housing of the anchor, the biasing element being preloaded by a tensioning member arranged in an internal chamber of the anchor.

Embodiment 2. The method according to any prior embodiment, wherein introducing the activation force includes increasing annular pressure about the anchor setting system.

Embodiment 3. The method according to any prior embodiment, wherein introducing the activation force releases a trigger restraining the biasing element.

Embodiment 4. The method according to any prior embodiment, wherein introducing the activation force includes forcing the slip along the housing.

Embodiment 5. The method according to any prior embodiment, wherein forcing the slip along the housing includes breaking a frangible fastener securing the slip to the housing.

Embodiment 6. The method according to any prior embodiment, further comprising: sensing that the activation force did not set the anchor; and introducing another activation force to set the anchor without removing the tubular from the wellbore.

Embodiment 7. The method according to any prior embodiment, wherein introducing the another activation force includes increasing internal pressure of a tubular supporting the anchor.

Embodiment 8. The method according to any prior embodiment, wherein increasing internal pressure of the tubular includes shifting a trigger restraining the biasing element.

Embodiment 9. The method according to any prior embodiment, wherein increasing internal pressure of the tubular includes forcing a piston radially outwardly relative to the housing.

Embodiment 10. The method according to any prior embodiment, wherein introducing the another activation force includes contacting a mechanical actuator with a surface of the wellbore and releasing the biasing element with the mechanical actuator.

Embodiment 11. The method according to any prior embodiment, further comprising: sensing that the another activation force did not set the anchor; and introducing yet another activation force without reconfiguring the anchor setting system to set the anchor.

Embodiment 12. The method according to any prior embodiment, wherein introducing the yet another activation force includes: contacting a mechanical actuator with a surface of the wellbore; and releasing the biasing element with the mechanical actuator.

Embodiment 13. The method according to any prior embodiment, wherein the activation force includes increasing internal pressure of a tubular supporting the anchor.

Embodiment 14. The method according to any prior embodiment, further comprising: milling a window in the casing tubular.

Embodiment 15. The method according to any prior embodiment, comprising: applying set down weight to the tubular to set the anchor after the biasing element pushes the slip into contact with the casing tubular.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of activating an anchor supported by a tubular in a wellbore having a casing tubular, the method comprising:

introducing an activation force to an anchor setting system;

shifting a trigger supported by the tubular to disengage from and release a slip supported by a housing of the anchor; and shifting the slip relative to the housing with a biasing element arranged in the slip, the biasing element being preloaded by a tensioning member arranged in an internal chamber of the anchor.

2. The method of claim 1, wherein introducing the activation force includes increasing annular pressure about the anchor setting system.

3. The method of claim 2, wherein shifting the trigger includes biasing the trigger radially outwardly of the housing with the activation force.

4. The method of claim 2, wherein introducing the activation force includes forcing the slip along the housing.

5. The method of claim 4, wherein forcing the slip along the housing includes breaking a frangible fastener securing the slip to the housing.

6. The method of claim 1, further comprising:

sensing that the activation force did not set the anchor; and introducing another activation force to set the anchor without removing the tubular from the wellbore.

7. The method of claim 6, wherein introducing the another activation force includes increasing internal pressure of a tubular supporting the anchor.

8. The method of claim 7, wherein increasing internal pressure of the tubular includes shifting a trigger restraining the biasing element.

9. The method of claim 7, wherein increasing internal pressure of the tubular includes forcing a piston radially outwardly relative to the housing.

10. The method of claim 6, wherein introducing the another activation force includes contacting a mechanical actuator with a surface of the wellbore and releasing the biasing element with the mechanical actuator.

11. The method of claim 6, further comprising:

sensing that the another activation force did not set the anchor; and introducing yet another activation force without reconfiguring the anchor setting system to set the anchor.

12. The method of claim 11, wherein introducing the yet another activation force includes:

contacting a mechanical actuator with a surface of the wellbore; and releasing the biasing element with the mechanical actuator.

13. The method according to claim 6, wherein the activation force includes increasing internal pressure of a tubular supporting the anchor.

14. The method of claim 1, further comprising: milling a window in the casing tubular.

15. The method of claim 1, further comprising: applying set down weight to the tubular to set the anchor after the biasing element pushes the slip into contact with the casing tubular.

16. A method of activating an anchor supported by a tubular in a wellbore having a casing tubular, the method comprising:

introducing an activation force to an anchor setting system by increasing annular pressure to release a biasing element arranged in a slip supported by a housing of the anchor, the biasing element being preloaded by a tensioning member arranged in an internal chamber of the anchor.

* * * * *